United States Patent [19]

Johnson et al.

[11] 4,022,130

[45] May 10, 1977

[54] EJECTABLE FUZE

[75] Inventors: Clifford T. Johnson; Melvin J. McCubbin; Patrick M. McInnis; Joseph F. Mattis, all of Ridgecrest, Calif.

[73] Assignee: The United States of America as represented by the Secretary of the Navy, Washington, D.C.

[22] Filed: Feb. 6, 1976

[21] Appl. No.: 655,928

[52] U.S. Cl. ..... 102/56 R; 102/1 R; 102/70 R

[51] Int. Cl.[2] ..... F42B 33/04

[58] Field of Search ..... 102/1 R, 56 R, 70 R, 102/105; 169/42, 57

[56] References Cited

UNITED STATES PATENTS

| | | | |
|---|---|---|---|
| 3,173,364 | 3/1965 | Nordzell | 102/1 |
| 3,665,857 | 5/1972 | Radnich et al. | 102/1 |
| 3,972,289 | 8/1976 | Morris | 102/70 R |

*Primary Examiner*—Verlin R. Pendegrass

*Attorney, Agent, or Firm*—R. S. Sciascia; Roy Miller; G. F. Baker

[57] ABSTRACT

A warhead fuze is attached within the warhead casing in such a manner that pressure buildup will cause the fuze mechanism to be ejected from its housing. The fuze and its associated booster is contained in a cup attached to an end cap which may be threaded to receive a closure cap. The joint between the booster cup and the end cap is made in such a manner that pressure buildup within the cup will case the joint to fail with a resultant expulsion of said booster cup away from the main explosive cavity.

5 Claims, 2 Drawing Figures

EJECTABLE FUZE

BACKGROUND OF THE INVENTION

For safety reasons, qualification of a warhead includes a requirement of survivability in an open flame environment. The presence of a live warhead, for example, on a carrier deck during a fire will greatly deter efforts to extinguish the flame and will present a real hazard to personnel, aircraft on the deck and even the ship itself. The chances of a warhead exploding in a fire situation is greatly lessened if the warhead booster is not present. It is not convenient, however, to install the booster at the final moment before takeoff.

SUMMARY

According to the present invention, the booster cup is manufactured and installed in such a manner that a connection between the main body of the booster cup and the end cap is situated outside of the main explosive cavity and this connection is designed to part under conditions of high temperature. The temperature at which the joint will fail is designed to be such that will be exceeded in an open flame environment. By the time the connection or joint parts, pressure from deterioration of the booster material will have created sufficient pressure within the booster cup to cause the fuze mechanism and the remains of the booster material to move away from the main explosive cavity.

DESCRIPTION AND OPERATION

Figure 1:
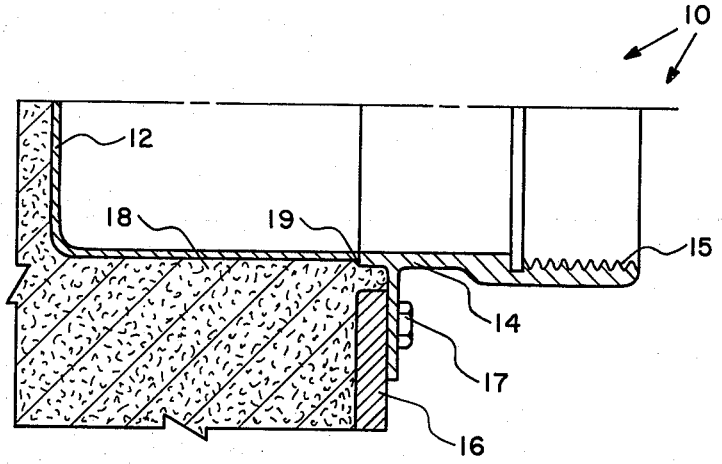
(PRIOR ART) FIG. 1
FIG. 1 is a fragmentary view of a longitudinal cross section of a prior art warhead showing the installation of the fuze housing.

The construction and operation of the present invention is best understood by a reference to the prior art construction generally indicated at 10 in FIG. 1. The fuze container shown in FIG. 1 consists of a booster cup 12 fastened to a cap and support member 14. The member 14 is shown threaded internally at 15 to receive the fuze mechanism (not shown). The support member 14 is fastened to the rear bulkhead 16 of the warhead casing which surrounds the main explosive charge 18. This featuring may be accomplished by one or more belts 17.

Figure 2:
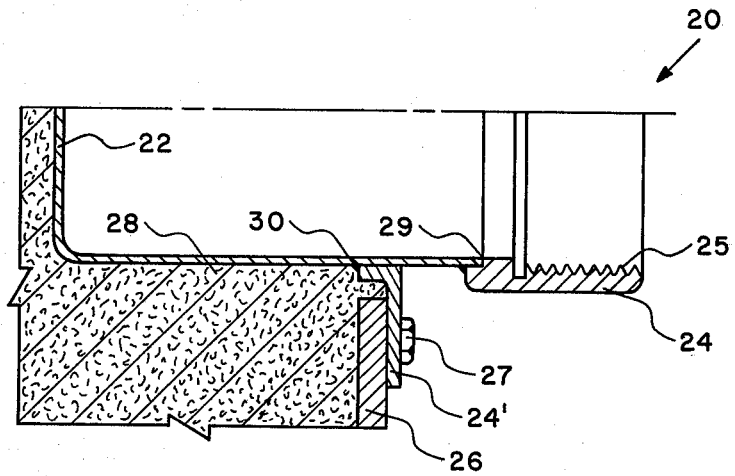
FIG. 2 is a view similar to FIG. 1 illustrating one embodiment of the present invention.

The construction generally indicated at 20 in FIG. 2 shows the booster cup 22 having a greater length than booster cup 12. The end cap 24 is not integral with the support which is shown at 24'. Otherwise the construction is very similar to FIG. 1 with the numerals 25–29 corresponding roughly to numerals 15–19 respectively of FIG. 1. In the prior art device (FIG. 1) the cup being attached to the end cap and support member 14 presented a construction wherein the weakest part of the fuze housing was at the connection 19 between the cup 12 and the end member 14. This connection was within the cavity enclosing the main explosive 18.

In contrast to the FIG. 1 device, the construction according to the present invention (FIG. 2) shows the connection between the booster cup 22 and end piece 24 is made at 29, outside of the cavity containing the main explosive 28. The separate support collar 24' is securely fastened to the booster cup 22 by means of a connection which will survive the temperature at which the connection 29 will fail. For example, the booster cup may be manufactured of sheet metal deep drawn to the desired length and fastened to the metal end piece 24 by means of a one-sixteenth inch 1100°F braze whereas the collar 24' is fastened onto the booster cup with a 1400°F braze 30 forward of bulkhead 36.

The brazed joint at 29 will fail when the warhead is subjected to an open flame environment resulting in the physical removal of the fuze and its associated booster from the vicinity of the main explosive charge. Because of the pressure buildup within the fuze housing, the fuze and booster will be ejected out of and away from the explosive main charge thereby greatly reducing the possibility of warhead detonation in the event of a booster reaction.

The joint between the collar 24' and the booster cup 22 will not fail until a higher temperature is encountered and meanwhile integrity of the main explosive cavity at that point is maintained.

What is claimed is:

1. In a warhead mechanism comprising a cavity containing a main charge of high explosive confined between opposing bulkheads and a container for a fuze mechanism fastened within an opening in one of said bulkheads, the improvement comprising:

said container comprising an elongated cup shaped member having a closed end and an open end;

said cup shaped member being fastened within said one of said bulkheads with said closed end protruding within said cavity and said open end of said cup shaped member extending from said bulkhead on the side away from said explosive; and an annular end piece joined to the open end of said cup shaped member for closure thereof;

the joining of said end piece to said cup shaped member being made such that the joint will fail when a predetermined level of temperature is exceeded at said joint and a predetermined pressure is exceeded within said container.

2. The warhead mechanism of claim 1 wherein said joint consists of a one-sixteenth inch 1100°F braze.

3. The warhead mechanism of claim 2 further comprising means for fastening said cup shaped member within said one of said bulkheads comprising a collar having a central opening and peripheral means for fastening to said bulkhead and said cup shaped member being fastened within the central opening of said collar by a 1400°F braze.

4. The warhead mechanism of claim 1 further comprising means for fastening said cup shaped member within said one of said bulkheads comprising a collar having a central opening and peripheral means for fastening to said bulkhead and said cup shaped member being fastened within the central opening of said collar by a 1400°F braze.

5. The warhead mechanism of claim 4 wherein said joint consists of a one-sixteenth inch 1100°F braze.

* * * * *